US005572976A

United States Patent [19]

Minamitani et al.

[11] Patent Number: 5,572,976

[45] Date of Patent: Nov. 12, 1996

[54] AUTOMOBILE ENGINE CONTROL SYSTEM

[75] Inventors: Kunitomo Minamitani; Yasuyoshi Hori; Hiromi Yoshioka, all of Hiroshima-ken, Japan

[73] Assignee: Mazda Motor Corporation, Aki-gun, Japan

[21] Appl. No.: 376,361

[22] Filed: Jan. 23, 1995

[30] Foreign Application Priority Data

Jan. 21, 1994 [JP] Japan ..... 6-005052
Jul. 11, 1994 [JP] Japan ..... 6-158316

[51] Int. Cl.[6] ..... F02M 51/00

[52] U.S. Cl. ..... 123/478

[58] Field of Search ..... 123/428, 480, 123/492, 491; 364/431.04, 431.05

[56] References Cited

U.S. PATENT DOCUMENTS 5,215,062 6/1993 Asano et al. ..... 123/491
5,270,935 12/1993 Dudek et al. ..... 123/480
5,282,449 2/1994 Takahashi et al. ..... 123/480
5,293,533 3/1994 Dudek et al. ..... 364/431.04
5,337,719 8/1994 Togai ..... 123/478
5,367,462 11/1994 Klenk et al. ..... 364/431.05
5,390,641 2/1995 Yamada et al. ..... 123/491
5,435,285 7/1995 Adams et al. ..... 123/492

FOREIGN PATENT DOCUMENTS 63-8296 2/1988 Japan .

*Primary Examiner*—Raymond A. Nelli
*Attorney, Agent, or Firm*—Keck, Mahin & Cate

[57] ABSTRACT

An automobile engine control system estimates a required amount of intake air to be introduced at the end of an intake stroke, based on a change in a factual amount of intake air introduced prior to the end of an intake stroke, and determines a control parameter for controlling engine output based on the required amount of intake air. When the engine operates in a high pulsation range of engine loads, in which pulsation of intake air is at a high level, the determination of the control parameter is based on the required amount of intake air.

15 Claims, 10 Drawing Sheets ne →

| Vecca ↓ | 1,000 | 2,000 | 3,000 | 4,000 | — — · |
|---|---|---|---|---|---|
| 0.125 | 1.0 | 1.0 | 1.0 | 1.0 | |
| 0.25 | 1.0 | 0.98 | 0.98 | 0.99 | |
| 0.375 | 0.98 | 0.98 | 0.99 | 0.99 | |
| 0.5 | 0.97 | 0.98 | 0.99 | 0.98 | |
| ⋮ | | | | | |

ne →

| Ce ↓ | 1,000 | 2,000 | 3,000 | 4,000 | — — · |
|---|---|---|---|---|---|
| 0.0 | 6 | 8 | 10 | 15 | |
| 0.25 | 10 | 12 | 14 | 18 | |
| 0.5 | 12 | 11 | 13 | 15 | |
| 0.75 | 10 | 11 | 12 | 13 | |

AUTOMOBILE ENGINE CONTROL SYSTEM

BACKGROUND OF THE INVENTION

1. Field of the Invention

The present invention relates to a control system for an engine of an automobile and, more particularly, to an automobile engine control system in which the amount of intake air to be introduced into an engine at the end of an intake stroke is predicted based on a factual amount of intake air introduced into the engine prior to the end of the intake stroke.

2. Description of Related Art

Typically, automobile engines of a fuel injection type have air-flow sensors for detecting the amount of intake air introduced into the engine. An engine control system calculates an air charging efficiency based on the factual amount of intake air and, after having determined and corrected a basic required amount of fuel according to the air charging efficiency, provides a control signal so as to inject the corrected amount of fuel into the engine.

In a case in which the engine control system determines the air charging efficiency based on the factual amount of intake air detected by, for instance, an air-flow sensor at the end of an air intake stroke, it is too late for the calculation of a required amount of fuel and, hence, injection of the required amount of fuel. Accordingly, it is essential to determine an air charging efficiency based on the factual amount of intake air detected prior to the end of an air intake stroke. While this does not provide any problems for engine operation under ordinary driving conditions, nevertheless, because changes in the amount of intake air may possibly occur at the end of an air intake stroke after detection of the intake air amount under transitional driving conditions, such as acceleration and deceleration, it is regarded that the detection of intake air amount is not always adequate and accurate.

In order to avoid such an inadequate detection, it has been proposed to estimate or predict a required amount of intake air to be introduced at the end of an intake stroke based on a change in the factual amount of intake air detected by an air-flow sensor prior to the end of the intake stroke and determine engine control parameters according to the required amount of intake air. Such an automobile engine control system is known from, for instance, Japanese Unexamined Patent Publication No.63-8296.

However, the engine control system described in the above publication has a problem in that the air-flow sensor is exposed to pulsation of intake air which is caused due to intermittent introduction of intake air into cylinders. Because a "hot-wire" type of air-flow sensor is very sensitive to such pulsation, an output of the air-flow sensor often reflects the pulsation of intake air on the required amount of intake air. This is more remarkable when the required amount of intake air is estimated by multiplying the sensor output by an estimate coefficient, leading to an inaccurate required amount of intake air. An inaccurate required amount of intake air results in an error in fuel injection and, as a result, a large change in air-fuel ratio, so as to provide a deterioration in emission control. This is because the pulsation of intake air is apparently amplified by the estimate coefficient.

SUMMARY OF THE INVENTION

It is an object of the present invention to provide an engine control system which prevents a required amount of intake air estimated under a range of high engine loads from being amplified due to pulsation of intake air by specifying engine operating conditions or conditions of estimate under which the required amount of intake air to be introduced at the end of an intake stroke is estimated based on a factual amount of intake air detected prior to the end of the intake stroke.

The above object of the present invention is achieved by providing a particular engine control system for an automotive vehicle. In this system, a required amount of intake air to be introduced into an engine at the end of an intake stroke is estimated based on a change in a factual amount of intake air introduced into the engine prior to the end of the intake stroke, which is detected by, for instance, a hot wire type of air-flow sensor for detecting a rate of intake air flow, and controlling engine output of the engine according to the required amount of intake air. The estimate of the required amount of intake air is restrained while the engine operates in a range of high engine loads where notable pulsation of intake air is caused.

Specifically, the required amount of intake air is calculated by use of an estimate coefficient obtained based on a change in the factual amount of intake air. This estimate coefficient may be varied such that it changes less in the range of high engine loads where pulsation of intake air is notable than in a range of low engine loads where pulsation of intake air is weak. Otherwise, the estimate of the required amount of intake air may be prohibited in the range of high engine load.

According to another embodiment of the present invention, the engine control system controls or determines a control parameter, such as pulse width of an injection pulse, for controlling engine output based on a required amount of intake air to be introduced at the end of an intake stroke which is determined based on a change in a factual amount of intake air introduced prior to the end of the intake stroke, and prohibits the control or determination of the control parameter, or otherwise restrains the estimate of the required amount of intake air, while detecting an engine operating condition within the range of high engine loads where pulsation of intake air is notable. Desirably, the prohibition and the estimate are maintained for a predetermined time from a time at which an engine operating condition within said high pulsation range is detected.

With the engine control system in accordance with one preferred embodiment of the present invention, in the high pulsation range, such as the range of high engine loads, the estimate of a required amount of intake air, which is made based on a factual amount of intake air, is restrained, or otherwise prohibited, so as to eliminate a large error in measurement of the required amount of intake air due to pulsation of intake air. Further, when making a utilization of an estimate coefficient which is obtained based on a change in the factual amount of intake air, the estimate coefficient is corrected less in the high pulsation range than in a range where pulsation of intake air is weak, providing an accurate estimate of the required amount of intake air because of lenient reflection of intake air pulsation on the required amount of intake air.

Further, with the engine control system in accordance with another preferred embodiment of the present invention, while the estimate of a required amount of intake air at the end of an intake stroke is always performed based on a factual amount of intake air before the end of the intake stroke, nevertheless, it is not used in controlling an engine control parameter, such as a fuel injection pulse, in the high pulsation range. Accordingly, pulsation of intake air reflects on the required amount of intake air, providing the control parameter with no error. This leads to an improved control of engine emission. In addition, either restraining the estimate of a required amount of intake air or controlling the engine control parameter is commenced only after a predetermined time, from a time at which a transition of an engine operating condition into the high pulsation range, has elapsed. Consequently, a rapid change in the amount of fuel injection, and hence engine output, is prevented, providing a comfortable feeling of engine operation. Alternatively, either restraining the estimate of a required amount of intake air or controlling the engine control parameter is commenced when, in the high pulsation range, a difference between the factual amount of intake air and a tempered amount of intake air, obtained by tempering the factual amount of intake air with a volumetric factor intrinsic to an intake system of the engine, is less than a predetermined level. As a result, a rapid change in the amount of fuel injection and, hence, engine output, is prevented, providing a comfortable feeling of engine operation.

BRIEF DESCRIPTION OF THE DRAWINGS

The above and other objects and features of the present invention will be clearly understood from the following description of preferred embodiments thereof when considered in conjunction with the accompanying drawings, in which.

DESCRIPTION OF THE PREFERRED EMBODIMENTS

Figure 1:
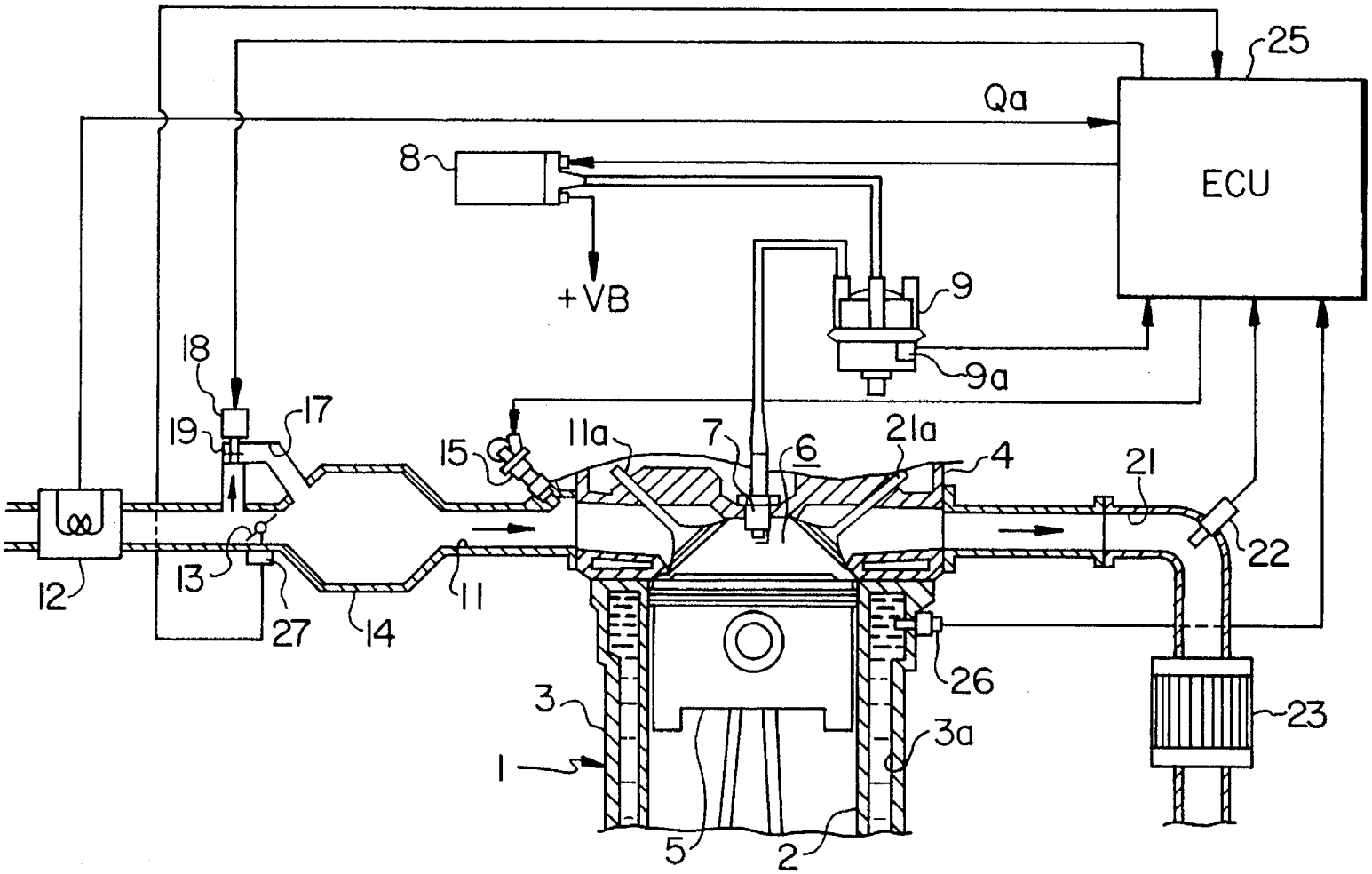
FIG. 1 is a schematic illustration of an automotive engine equipped with an engine control system in accordance with the present invention.

Referring now to the drawings in detail and, in particular, to FIG. 1, an internal combustion engine 1, cooperating with the engine control system in accordance with a preferred embodiment of the present invention, is shown. The engine 1 has a cylinder block 3, provided with a plurality of cylinders 2 (only one of which is shown) in which pistons 5 can slide, and a cylinder head 4 attached onto the cylinder block 3. A combustion chamber 6 is formed in each cylinder 2 by the top of the piston 5, a lower wall of the cylinder head 4 and a cylinder wall of the cylinder 2. Each cylinder 2 is formed with an intake port and an exhaust port opening into the combustion chamber 6. The intake port and the exhaust port are opened and shut at a predetermined timing by an intake valve 11*a* and an exhaust valve 21*a*, respectively. An ignition plug 7 is provided in the cylinder head 4 facing the combustion chamber 6. This ignition plug 7 is connected to an ignition coil 8, which generates a high potential of secondary voltage, in response to an ignition signal from an engine control unit 25, through a distributor 9.

The engine 1 has an intake pipe 11 through which fresh air is introduced into the combustion chamber 6 of the engine 1. This intake pipe 11 is provided, in order from the upstream end, with an air cleaner (not shown), a hot wire type of air flow sensor 12, a throttle valve 13, a surge tank 14 and an injector 15. The intake pipe 11 is further provided with a bypass pipe 17 so as to allow a flow of intake air to bypass the throttle valve 13. An idle speed control (ISC) valve 19 is operated by an actuator 18 to change its opening so as to regulate the engine speed during idling.

Similarly, the engine has an exhaust pipe 21 through which burned gases are discharged from the engine 1. The exhaust pipe 21 is provided, in order from the upstream end, with an air-fuel ratio sensor 22 and an exhaust gas purifying device 23. The air-fuel ratio sensor 22, which detects an air-fuel ratio based on the concentration of oxygen in exhaust gases, may be of a linear type of oxygen ($O_2$) sensor which provides a signal changing in proportion to changes in air fuel ratio.

The fuel injector 15, the ignition coil 8 and the actuator 18 are controlled, in operation, by the engine control unit 25 including a microcomputer. The engine control unit 25 receives various signals including at least an air flow signal representative of the amount of intake air from the air flow sensor 12, a crank angle signal representative of an angle of rotation of the distributor 9 which is used to detect an engine speed, an air-fuel ratio signal from the air-fuel ratio sensor 22, a temperature signal representative of the temperature of cooling water from a temperature sensor 26 which is installed in a water jacket 3*a*, a throttle opening signal representative of an opening of the throttle valve 13 from a throttle sensor 27. These sensors may be of any type well known in the art.

The fuel injector 15 receives an injection signal, such as an injection pulse, and delivers fuel in an amount depending upon a pulse width of the injection pulse. This injection signal is processed by the engine control unit 25. The sequential process made by the engine control unit 25 will be best understood by reviewing FIG. 2, which is a flow chart illustrating an injection control sequence routine for the microcomputer. Programming a computer is a skill well understood in the art. The following description is sufficient to enable a programmer having ordinary skill in the art to prepare an appropriate program for the microcomputer. The particular details of any such program would, of course, depend upon the architecture of the particular computer selected.

Figure 2:
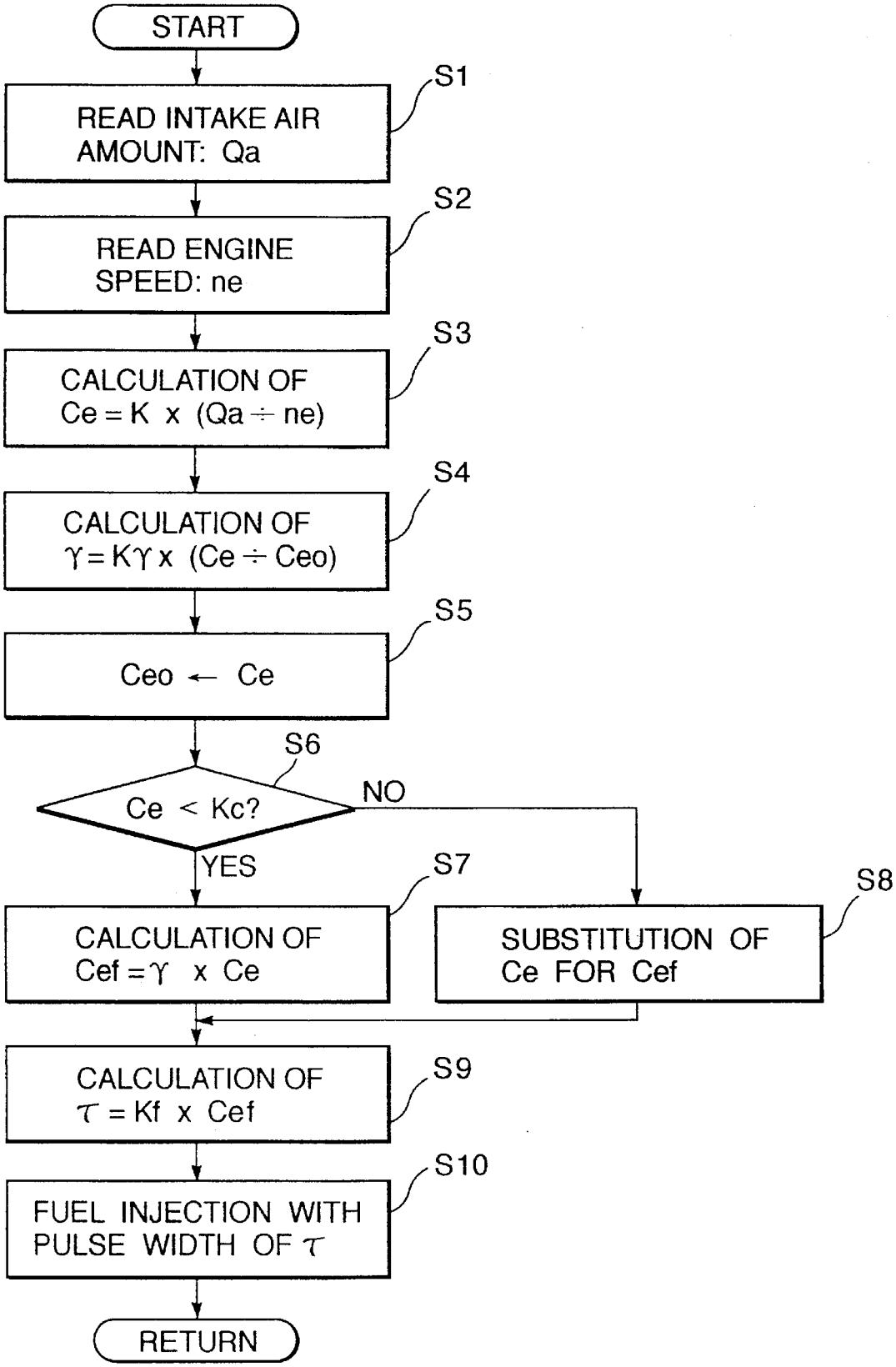
FIG. 2 is a flow chart illustrating an engine control sequence routine of the control system in accordance with a preferred embodiment of the present invention.

Referring to FIG. 2, the sequence routine commences and control passes directly to a function block at step S1 where an air flow signal Qa is read in from the air-flow sensor 12. Subsequently, at step S2, an engine speed ne is calculated based on a crank angle signal from the distributor angle sensor 9*a*. Then, at step S3, an air charging efficiency Ce (which is representative of the amount of intake air) is calculated by use of the following equation:

$$Ce=K\times(Qa\div ne)$$

where K is a constant. Further, at step S4, an estimate coefficient $\gamma$, which is used to estimate the required amount of intake air, is calculated by use of the following equation:

$$\gamma=K_{\gamma}\times(Ce\div Ceo)$$

In this equation, $K_{\gamma}$ is a constant and Ceo is the air charging efficiency in the last cycle of the routine.

After having replaced the last air charging efficiency Ceo with the current air charging efficiency Ce at step S5, a decision is made at step S6 as to whether the current air charging efficiency Ce is less than a predetermined air charging efficiency Kc which is invariable.

If the current air charging efficiency Ce is less than the predetermined air charging efficiency Kc, this indicates that the engine is regarded to be operating in a range of low engine loads. Then, at step S7, an estimated air charging efficiency Cef is obtained by multiplying the current air charging efficiency Ce by the estimate coefficient $\gamma$. On the other hand, if the current air charging efficiency Ce is equal to or greater than the predetermined air charging efficiency Kc, this indicates that the engine is operating in a range of high engine loads. Then, at step S8, the current air charging efficiency Ce is directly substituted for an estimated air charging efficiency Cef. After having determined the estimated air charging efficiency Cef at step S7 or step S8, pulse width $\tau$ of an injection pulse is calculated by multiplying the estimated air charging efficiency Cef by a constant Kf at step S9. Finally, the engine control unit 25 adjusts a pulse width and pulses the fuel injector 15 so as to deliver a correct amount of fuel according to the pulse width $\tau$ at step S10.

During operation of the engine 1, the air flow sensor 12 monitors the amount of intake air Qa prior to the end of an intake stroke. Based on the amount of intake air Qa and an engine speed ne, an air charging efficiency Ce and an estimate coefficient $\gamma$ are calculated. In order to determine or judge engine load conditions, this air charging efficiency Ce is compared to an invariable air charging efficiency Kc. As appearing at both end portions of the time chart shown in FIG. 3, when the air charging efficiency Ce is less than the invariable air charging efficiency Kc, with a small opening of the throttle valve 13, it is regarded that the engine is operating in a range of low loads in which intake air pulsation is weak. In such a case, an estimate on an air charging efficiency Ce at the end of an intake stroke is made based on an estimate coefficient $\gamma$ which is obtained from a change in air charging efficiency Ce obtained according to a factual amount of intake air Qa monitored by the air flow sensor 14 before the end of the intake stroke. The estimated air charging efficiency Cef, thus obtained, is used to determine pulse width $\tau$ of an injection pulse depending upon which the fuel injector 15 delivers a correct amount of fuel. On the other hand, as shown at the middle of the time chart shown in FIG. 3, when the air charging efficiency Ce is greater than the invariable air charging efficiency Kc, with an increased opening of the throttle valve 13, it is regarded that the engine is operating in a range of high loads in which intake air pulsation becomes larger than a predetermined level. In such a case, an estimate of an air charging efficiency Cef is not made and the current air charging efficiency Ce obtained based on a factual amount of intake air is used as an estimated air charging efficiency Cef.

Figure 3:
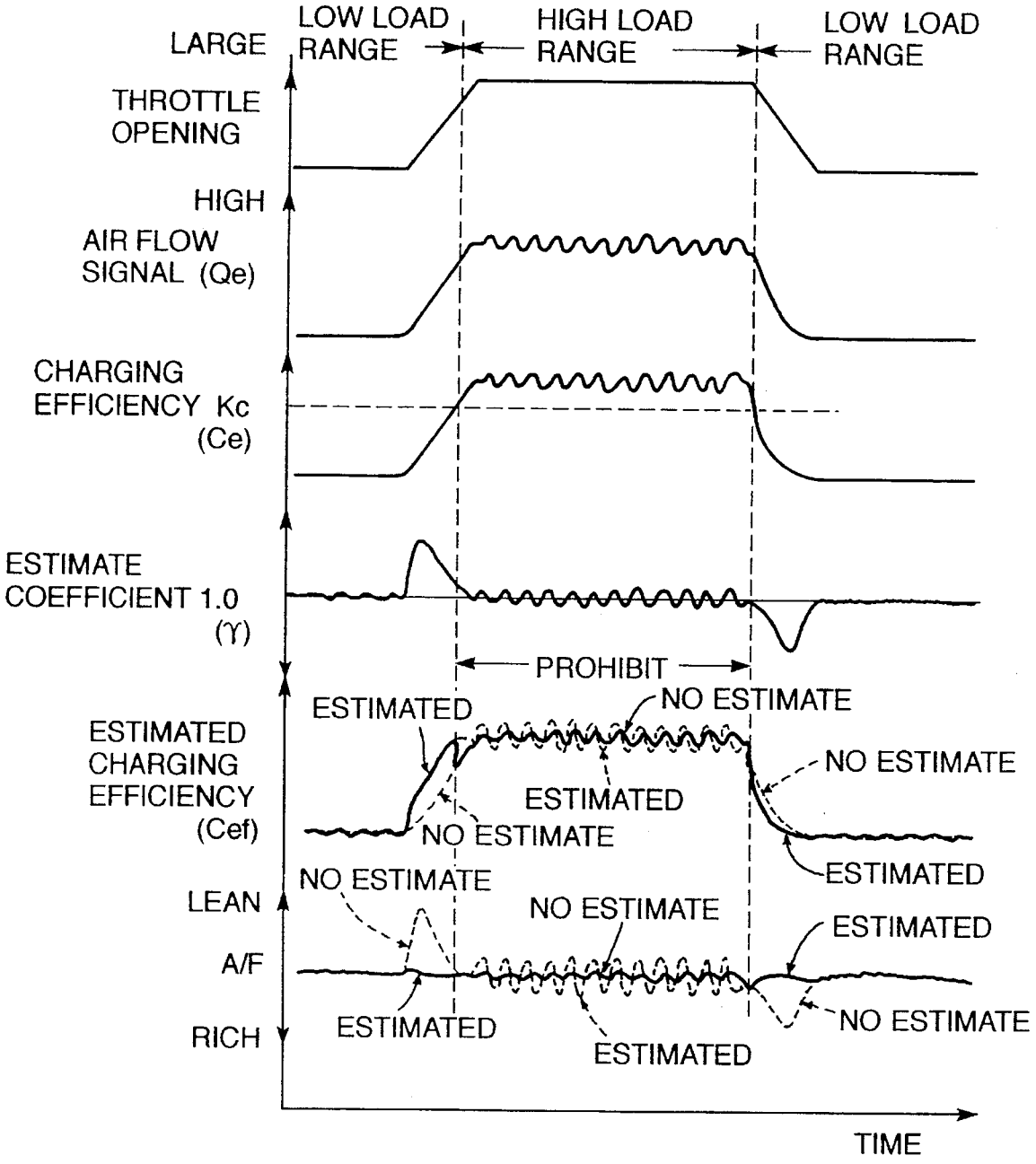
FIG. 3 is a time chart of the control sequence routine of FIG. 2.

In the range of high engine loads, in which large intake air pulsation occurs, because the current air charging efficiency Ce is substituted for an estimated air charging efficiency Cef, execution of the estimate of an air charging efficiency Cef for the end of an intake stroke, which is made based on an air charging efficiency Ce prior to the end of the intake stroke, is substantially prohibited. This prevents a great change in the air charging efficiency Ce at the end of an intake stroke due to amplified or enhanced intake air pulsation which occurs as a result of the estimate. Accordingly, if a hot wire air flow sensor 12 with a high sensitivity detects even a fine intake air pulsation caused with an increase in engine load, the control system effectively prevents fluctuations of the air-fuel ratio as shown in FIG. 3, providing an accurate estimate of air charging efficiency. This leads to an improvement in emission control.

Figure 4:
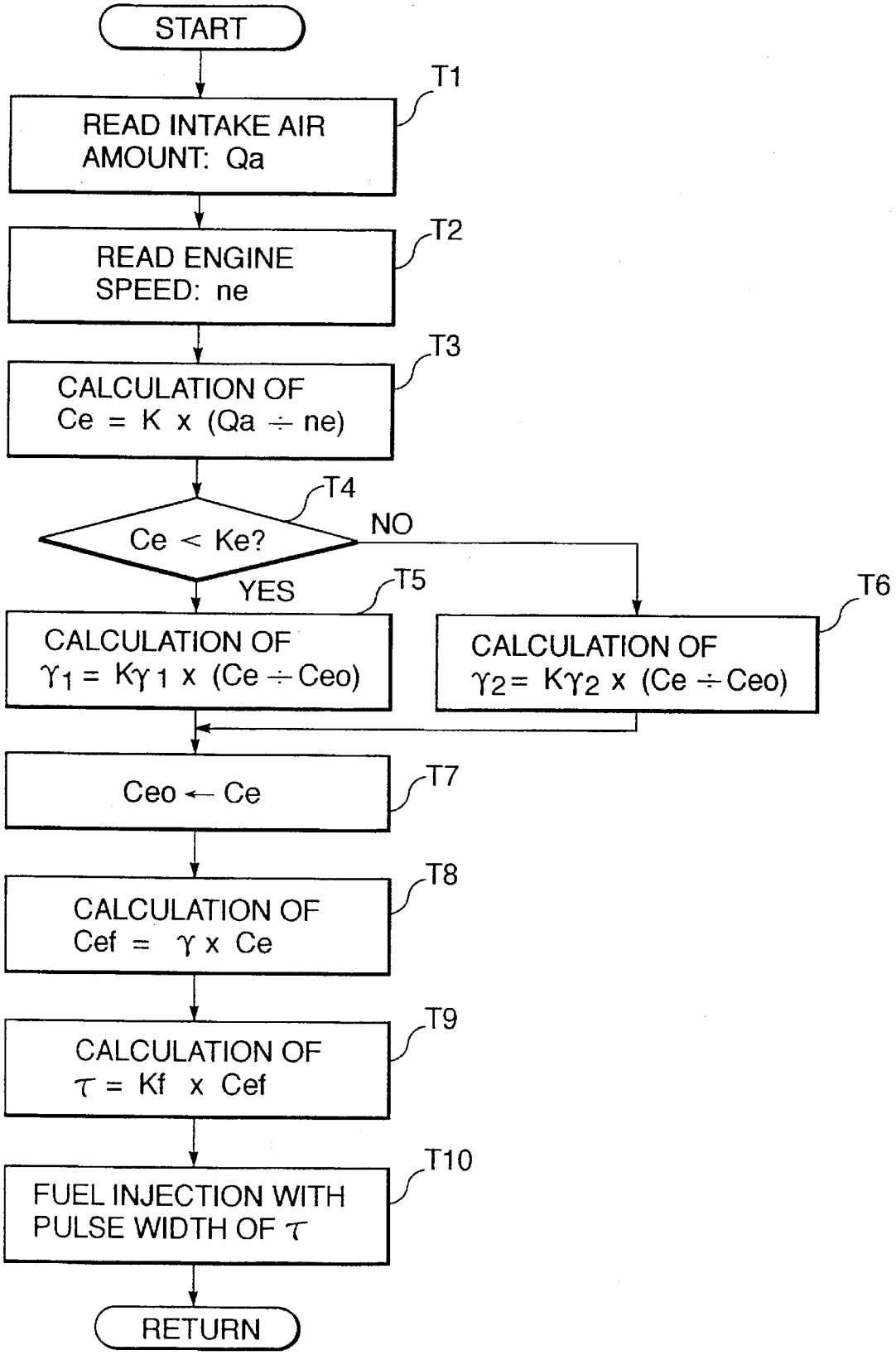
FIG. 4 is a flow chart illustrating an engine control sequence routine of the control system in accordance with another preferred embodiment of the present invention.

FIG. 4 is a flow chart of an engine control sequence routine of the engine control system according to another preferred embodiment of the present invention. In this embodiment, an estimate coefficient $\gamma$ is made smaller in a range of high engine loads, as compared with in a range of high engine loads. The sequence routine commences and control passes directly to a function block at step T1 at which an air flow signal Qa is read in from the air-flow sensor 12. Subsequently, after having calculated an engine speed ne based on a crank angle signal from the distributor angle sensor **9*a*** at step T2 and an air charging efficiency Ce at step T3, a decision is made at step T4 as to whether or not the current air charging efficiency Ce is less than a predetermined air charging efficiency Ke which is invariable. If the current air charging efficiency Ce is less than the predetermined air charging efficiency Ke, this indicates that the engine is regarded to be operating in a range of low engine loads in which intake air pulsation is weak. Then, at step S5, an estimate coefficient $\gamma_1$, which is used to estimate the amount of intake air, is calculated by use of the following equation:

$$\gamma_1=K_{\gamma 1}\times(Ce\div Ceo)$$

In this equation, $K_{\gamma 1}$ is a constant, and Ceo represents an air charging efficiency in the last cycle of the routine.

On the other hand, if the current air charging efficiency Ce is equal to or greater than the predetermined air charging efficiency Ke, this indicates that the engine is operating in a range of low engine loads in which intake air pulsation is larger than a specific level. Then, at step T6, an estimate coefficient $\gamma_2$ is calculated by use of the following equation:

$$\gamma_2=K_{\gamma 2}\times(Ce\div Ceo)$$

In the equation, $K_{\gamma 1}$ is a constant and smaller than $K_{\gamma 2}$.

After having calculated an estimate coefficient $\gamma_1$ or $\gamma_2$, the last air charging efficiency Ceo is replaced with the current air charging efficiency Ce at step T7. Subsequently, at step T8, an estimated air charging efficiency Cef is obtained by multiplying the current air charging efficiency Ce by the estimate coefficient $\gamma$. At step T9, a pulse width $\tau$ of an injection pulse is calculated by multiplying the estimated air charging efficiency Cef by a constant Kf. Finally, at step T10, the engine control unit 25 adjusts a pulse width and pulses the fuel injector 15 so as to deliver a correct amount of fuel according to the pulse width $\tau$.

In this embodiment, in place of prohibiting the estimate of an air charging efficiency, the estimate coefficient is changed so that is is smaller in the range of high engine loads in which intake air pulsation is more notable than in the range of low engine loads. Accordingly, amplification or enhancement of intake air pulsation caused by execution of the estimate of an air charging efficiency is weak in the range of high engine loads as compared with in the range of low engine loads. This provides an accurate estimate of air charging efficiency and restrains detection errors of air-fuel ratio, providing an improvement of emission control.

Figure 5:
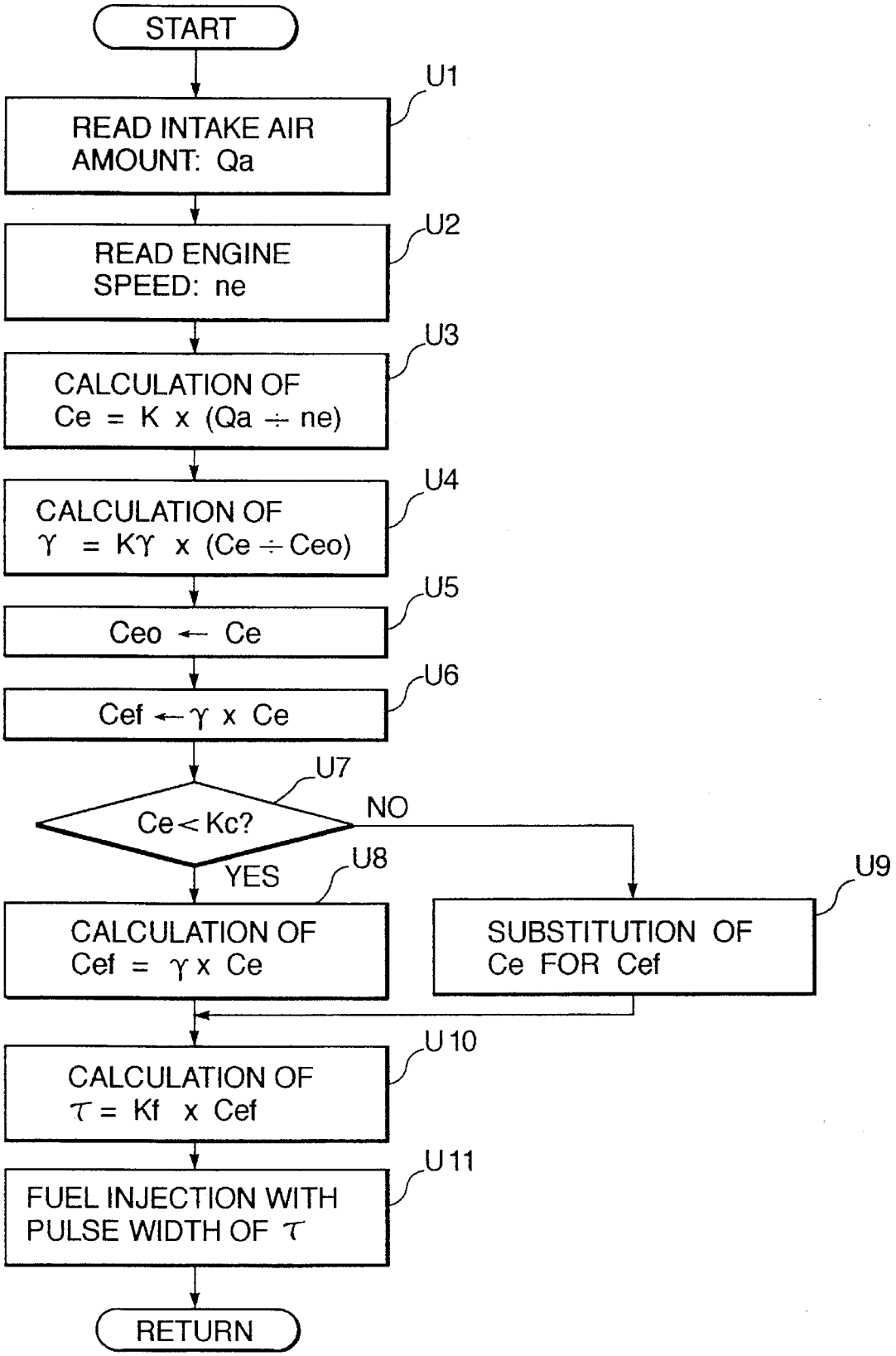
FIG. 5 is a flow chart illustrating an engine control sequence routine of the control system in accordance with still another preferred embodiment of the present invention.

FIG. 5 is a flow chart of an engine control sequence routine of the engine control system according to still another preferred embodiment of the present invention. In this embodiment, while an estimate of air charging efficiency is always made, nevertheless, the estimated air charging efficiency is not used for the determination of pulse width of an injection pulse.

After having read an air flow signal Qa at step U1 and calculated an engine speed ne at step U2, an air charging efficiency Ce is calculated by use of the air amount Qa, the engine speed ne and a constant K at step U3. Subsequently, an estimate coefficient $\gamma$ is calculated at step U4. After having replaced the last air charging efficiency Ceo with the current air charging efficiency Ce at step U5, an estimated air charging efficiency Cef is obtained by multiplying the current air charging efficiency Ce by the estimate coefficient $\gamma$ at step U6. Subsequently, a decision is made at step U7 as to whether or not the current air charging efficiency Ce is less than a predetermined air charging efficiency Kc.

If the current air charging efficiency Ce is less than the predetermined air charging efficiency Kc, then the engine is regarded to be operating in a range of low engine loads. Then, at step U8, the estimated air charging efficiency Cef is directly used. On the other hand, if the current air charging efficiency Ce is equal to or greater than the predetermined air charging efficiency Kc, then the engine is regarded to be operating in a range of high engine loads. Then, at step U9, the current air charging efficiency Ce is substituted as an estimated air charging efficiency Cef. After having determined the estimated air charging efficiency Cef at step U8 or step U9, a pulse width $\tau$ of an injection pulse is calculated based on the estimated air charging efficiency Cef at step U10. The fuel injector 15 is pulsed with an injection pulse having the pulse width $\tau$ so as to deliver a correct amount of fuel according to the pulse width $\tau$ at step U11.

According to this embodiment, the pulse width $\tau$ is regulated according, on one hand, to an estimated air charging efficiency Cef in the range of low engine loads and, on the other hand, to a current air charging efficiency in the range of high engine loads. Although the estimate of air charging efficiency is always executed both in the low engine load range and in the high engine load range, the estimated air charging efficiency is never used to determine the pulse width $\tau$ in the high engine load range. This prevents great changes in pulse width, i.e., the amount of fuel, caused due to the utilization of the estimated air charging efficiency.

In the above-described embodiments, the estimated air charging efficiency Cef may be used as a control parameter for controlling, for instance, a time of ignition in place of fuel injection.

Figure 6:
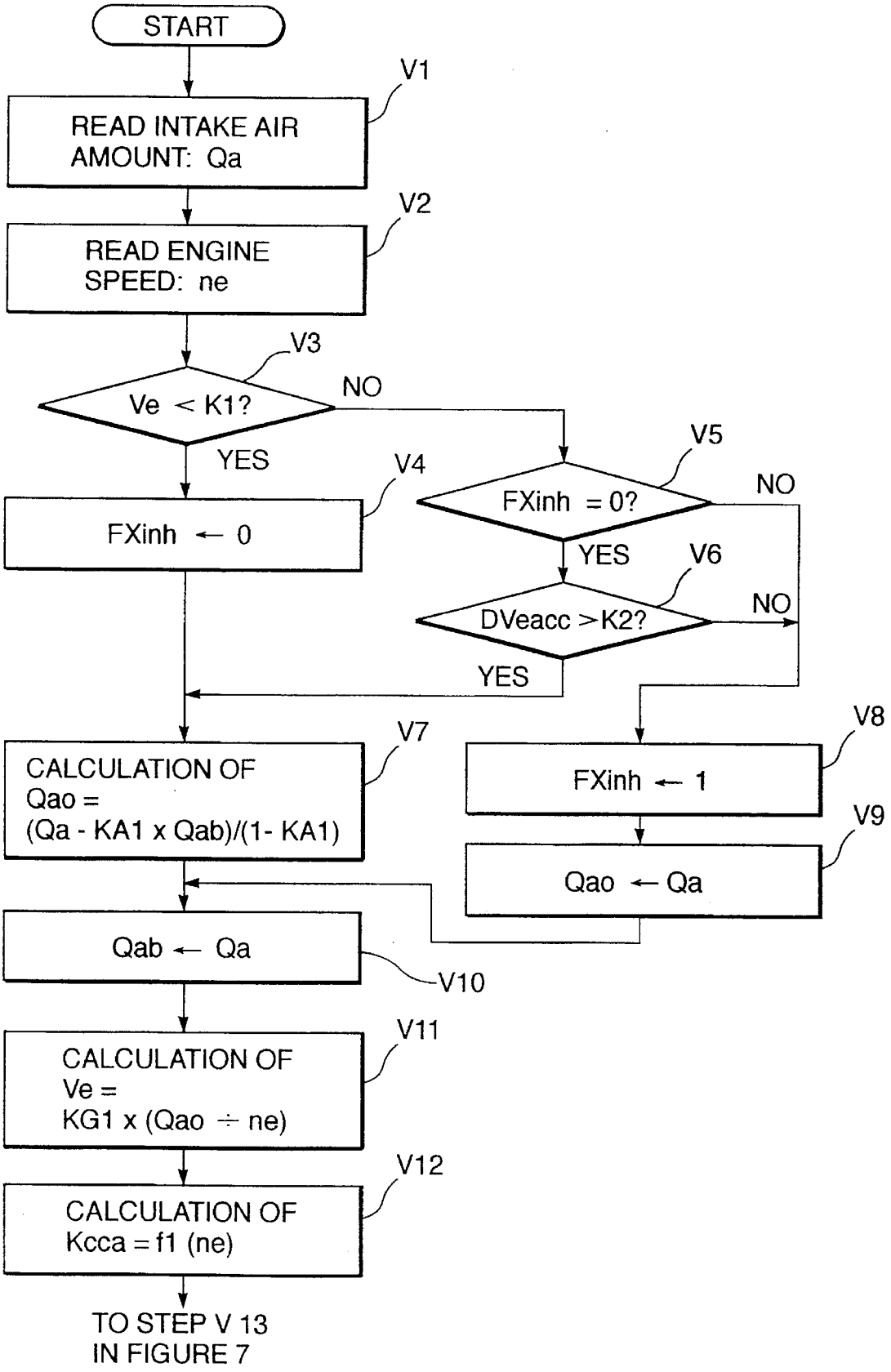
FIGS. 6–8 are flow charts illustrating an engine control sequence routine of the control system in accordance with another preferred embodiment of the present invention.
Figure 7:
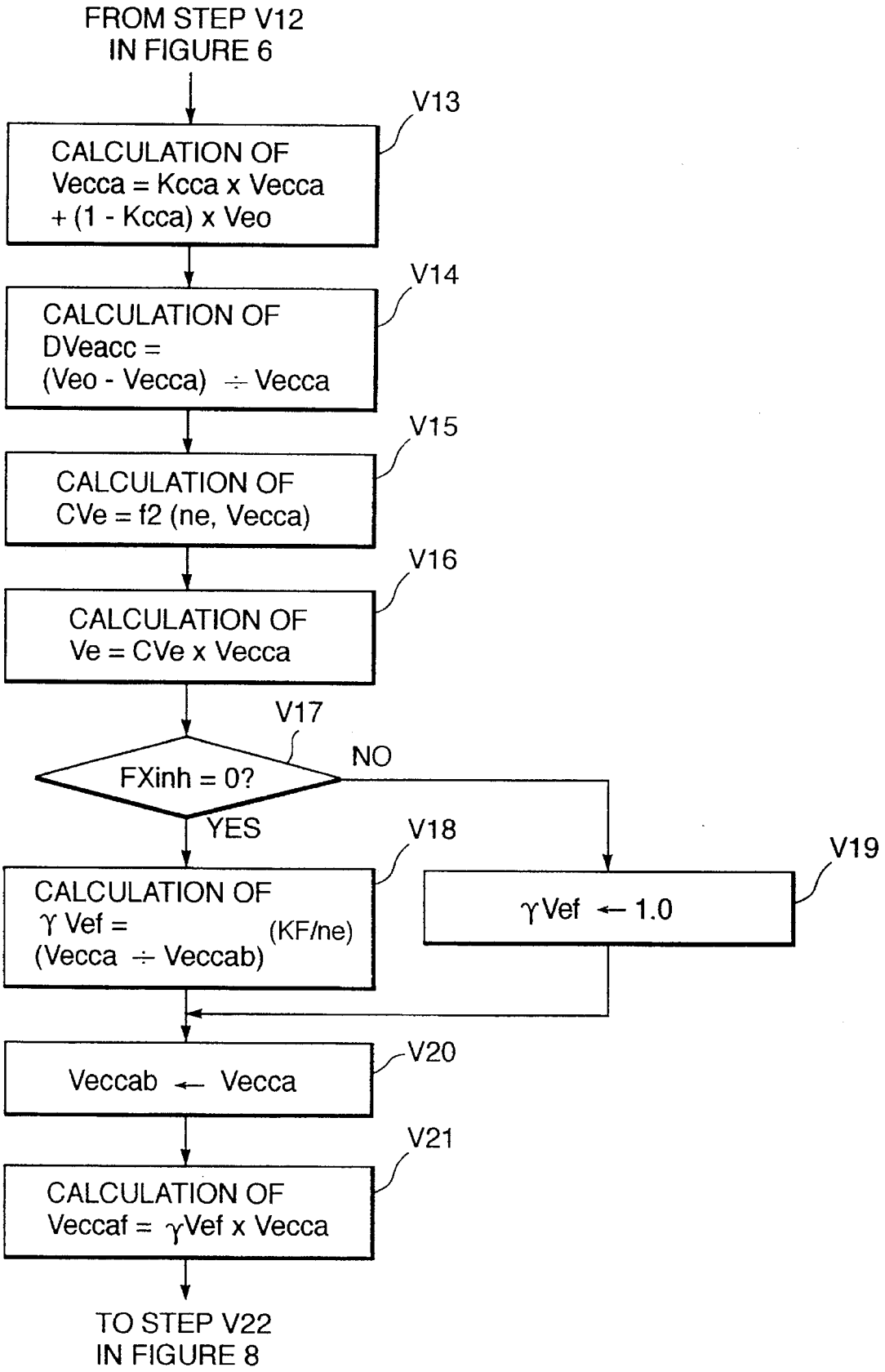
Figure 8:
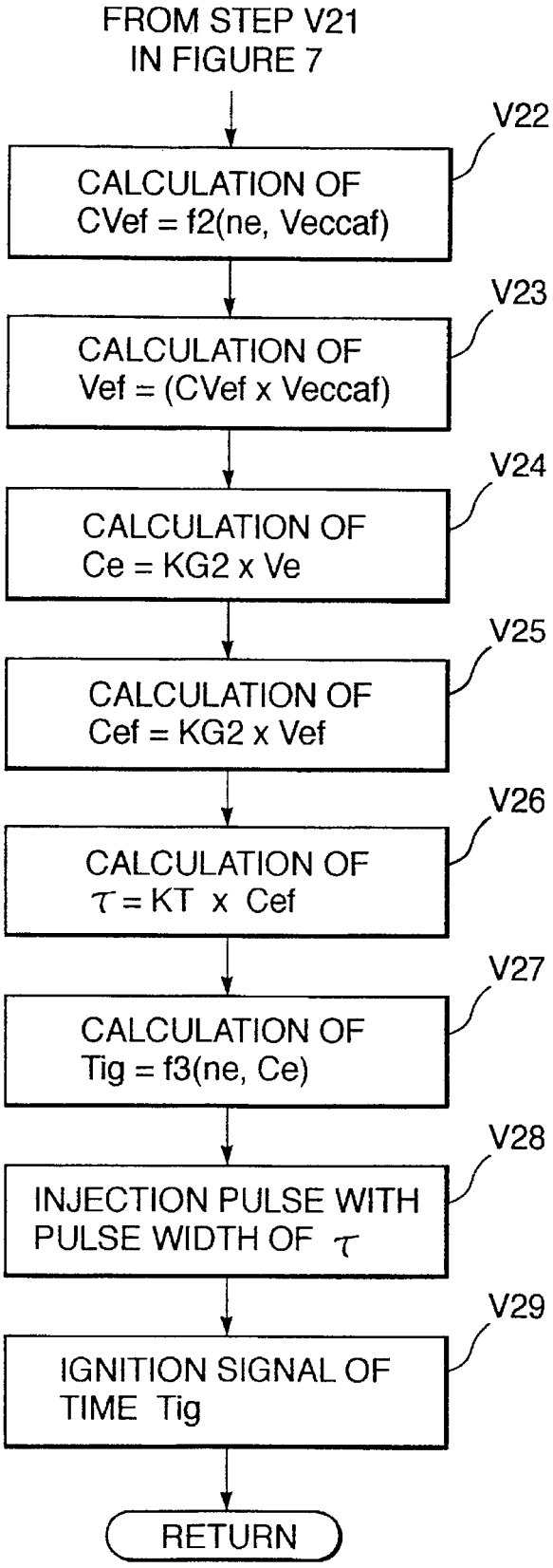

FIGS. 6–8 are flow charts illustrating an injection control sequence routine in accordance with another preferred embodiment of the present invention, in which restraint of the estimate of air charging efficiency is commenced after a predetermined time from a time at which engine load shifts to a high engine load range.

Referring to FIG. 6, the control sequence commences and control passes directly to a function block at step V1 in FIG. 6 at which the amount of intake air Qa is read from the air-flow sensor 12. Subsequently, at step V2, the speed of the engine ne is read in from the distributor angle sensor 9*a*. Then, a decision is made at step V3 as to whether or not a net efficiency of intake air volume Ve (which is obtained at step V16) is less than a predetermined first constant K1. If the net intake air volume efficiency Ve is smaller than the first constant K1, then, an inhibition flag FXinh is reset to a state of 0 (zero) at step V4. The inhibition flag FXinh indicates, when it is 1, that both estimate and correction of air charging efficiency, which will be described later, must be inhibited and, when it is 0 (zero), that both estimate and correction of air charging efficiency are allowed.

If the net intake air volume efficiency Ve is not smaller than the first constant K1, then, another decision is made at step V5 as to whether the engine 1 has attained a high engine load for the first time. The attainment of high engine load is judged by the fact that the inhibition flag FXinh is 0 (zero). If the answer to the decision is "YES," a decision is further made at step V6 as to whether a transitional judging coefficient DVeacc (which is obtained at step V14) is greater than a predetermined second constant K2.

After having reset the inhibition flag FXinh to the state of 0 (zero) at step V4 or when the answer to the decision made at step V6 is "YES", a corrective amount of intake air Qao is calculated by use of the following equation:

$$Qao=(Qa-kA1\times Qab)/(1-kA1)$$

where

Qa is the factual amount of intake air in the current cycle of the routine;

Qab is the amount of intake air in the last cycle of the routine; and kA1 is a constant which established to be greater than 0 and less than 1.

This correction is made in order to compensate a shortage of intake air due to a delay in response of a signal provided by the hot-wire type of air-flow sensor 12 which is caused due to heat capacity of the air-flow sensor 12. On the other hand, when the engine 1 has not yet attained a high engine load, and when the transitional judging coefficient DVeacc is less than a predetermined second constant K2, after having set the inhibition flag FXinh to the state of 1 at step V8, the corrective intake air amount Qao is substituted for a factual intake air amount Qa at step V9.

Subsequently to the provision of an intake air amount Qao at step V7 or step V9, the current intake air amount Qa is substituted for a last intake air amount Qab in another cycle of the routine at step V10. At step V11, an apparent volume efficiency of intake air Ve is calculated based on the engine speed ne and corrective intake air amount Qao by use of the following equation:

$$Ve=KG1\times(Qao\div ne)$$

In the equation, KG1 is a variable coefficient which becomes large as the temperature of intake air is high and as the atmospheric pressure is low. Otherwise, if desirable, the coefficient KG1 may be constant.

Figures 9, 10, 11:
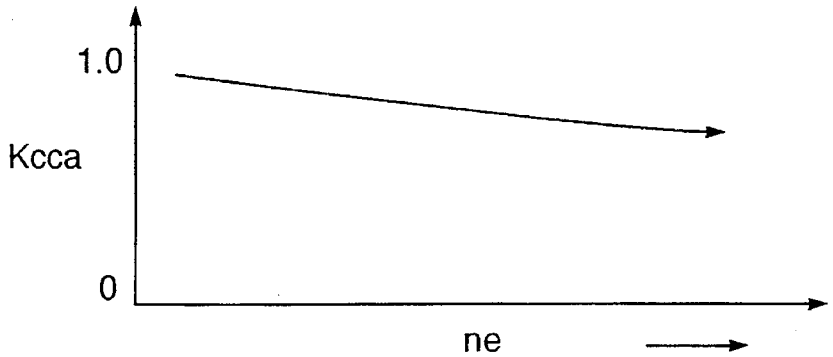
FIG. 9 is a characteristic diagram showing a transitional correction coefficient.
FIG. 10 shows a map of volume efficiency correction coefficients.
FIG. 11 shows a map of ignition time.
Figure 12:
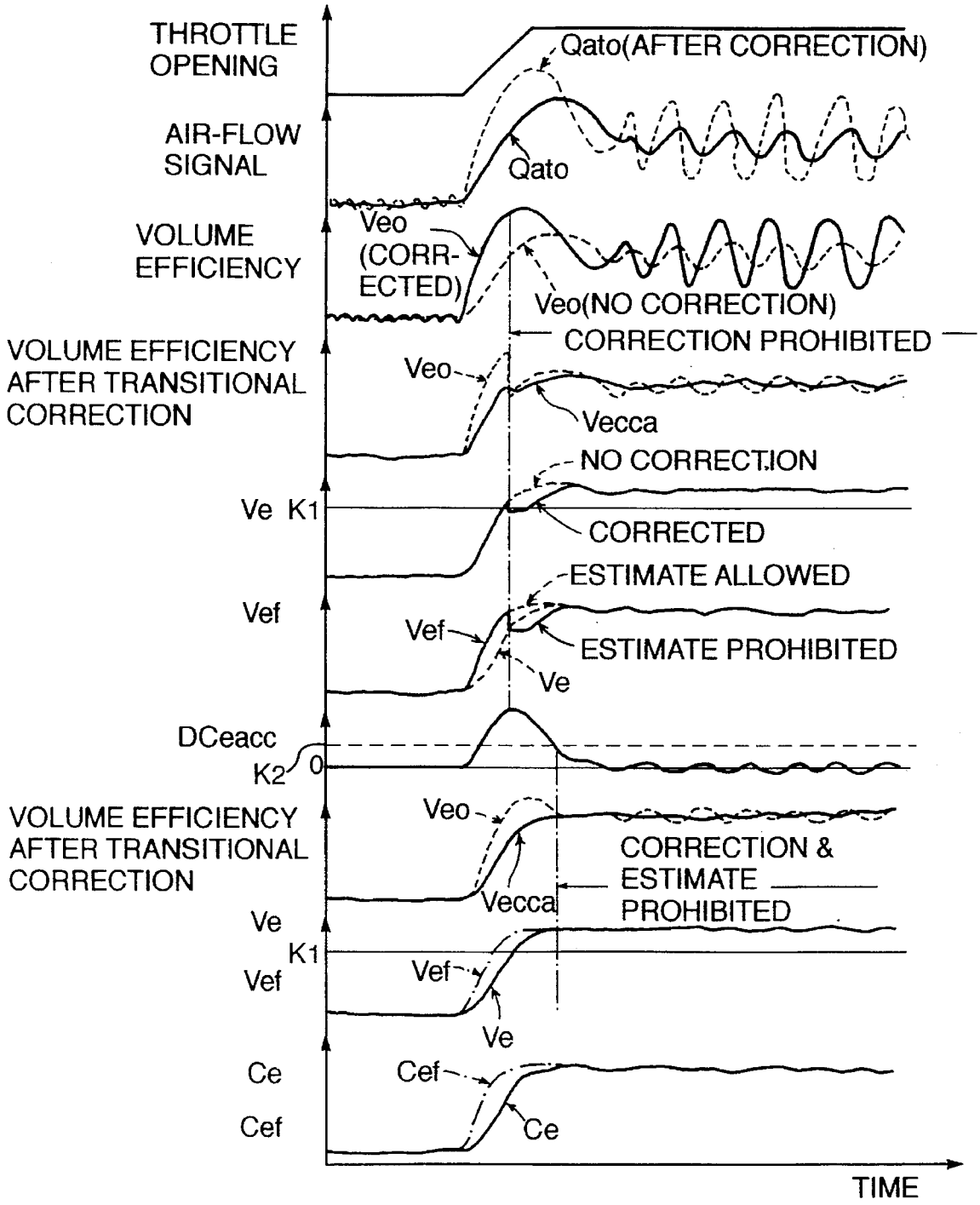
FIG. 12 is a time chart of the control sequence routine of FIGS. 6–8.

At step V12, a transitional correction coefficient Kcca is obtained. This transitional correction coefficient Kcca is previously established as a function $f_1$ of engine speed ne as shown in FIG. 9 such that it decreases gradually from 1.0 with an increase in engine speed ne. Subsequently, at step V13 in FIG. 7, a transitional corrective volume efficiency Vecca is calculated based on these apparent volume efficiency of intake air Veo and transitional correction coefficient Kcca by use of the following equation:

$$Vecca=Kcca\times Vecca+(1-Kcca)\times Veo$$

Further, at step V14, a transitional judging coefficient DVeacc is calculated based on the apparent volume efficiency of intake air Veo and the transitional corrective volume efficiency Vecca by use of the following equation:

$$DVeacc=(Veo-Vecca)\div Vecca$$

At step V15, a volume efficiency correction coefficient Cve is obtained from a correction map as shown in FIG. 10 in which volume efficiency correction coefficients Cve are previously established as a function f2 of engine speed ne and transitional corrective volume efficiency Vecca. This volume efficiency correction coefficient Cve is used to correct errors in the net intake air volume efficiency Ve, under ordinary driving conditions, with an aim to eliminate variations in properties among engine and air-flow sensors. Further, at step V16, a net volume efficiency Ve is obtained as a product of the volume efficiency correction coefficient Cve and transitional corrective volume efficiency Vecca.

Subsequently, a decision is made at step V17 as to whether the inhibition flag FXinh is in the state of 0 (zero). If the answer to this decision is "YES," i e. both estimate and correction of air charging efficiency are allowed, then, the estimate of a coefficient of air charging efficiency γVef is made based on the current transitional corrective volume efficiency Vecca and the last transitional corrective volume efficiency Veccab by use of the following equation:

$$\gamma Vef=(Vecca\div Veccab)^{(kF/ne)}$$

In the equation, kF is a constant.

On the other hand, if the answer to the decision made at step V17 is "NO," this indicates that both estimate and correction of air charging efficiency are inhibited. Then, at step V19, an air charging efficiency coefficient γVef is fixed to be 1.0.

Once an air charging efficiency coefficient γVef is obtained, either at step V18 or at step V19, after having held the current transitional corrective volume efficiency Vecca as a last transitional corrective volume efficiency Veccab for another cycle of the routine, at step V20, an estimated volume efficiency after transitional correction Veccaf is calculated by multiplying the transitional corrective volume efficiency Vecca by the air charging efficiency coefficient γVef at step V21. Thereafter, at step V22 in FIG. 8, a volume efficiency correction coefficient after correction CVef is obtained from a correction map (not shown) in which volume efficiency correction coefficients after correction CVef are previously established as a function f2 of engine speed ne and estimated volume efficiency after transitional correction Veccaf. This volume efficiency correction coefficient after correction CVef has the same effect as the volume efficiency correction coefficient CVe obtained at step V15. The map of volume efficiency correction coefficient after correction CVef is similar to the map of volume efficiency correction coefficient CVe but contains estimated volume efficiency after transitional correction Veccaf as a parameter in place of transitional corrective volume efficiency Vecca.

Subsequently, at step V23, a net estimated volume efficiency Vef is calculated by multiplying the volume efficiency correction coefficient after correction CVef by the estimated volume efficiency after transitional correction Veccaf. At step V24, an air charging efficiency Ce is calculated as a product of the net volume efficiency Ve and a coefficient KG2. In this instance, the coefficient KG2 is variable such that it becomes small as the temperature of intake air is high and as the atmospheric pressure is low. Otherwise, if desirable, the coefficient KG2 may be constant. Subsequently, at step V25, an estimated charging efficiency Cef is calculated as a product of the estimated air charging efficiency Cef and coefficient KG2.

Thereafter, at step V26, injection pulse width τ is calculated by multiplying the estimated air charging efficiency Cef by a constant KT. Subsequently, an ignition time Tig is determined from an ignition time map as shown in FIG. 11 in which ignition times are previously established as a function f3 of engine speed ne and air charging efficiency Ce. Then, an ignition pulse having the pulse width τ is provided so as to pulse the fuel injector 15, thereby delivering a correct amount of fuel at step V28. Almost simultaneously, an ignition pulse is provided for the ignition plug 7 so as to ignite fuel at the ignition time Tig at step V29. The final step orders another sequence routine.

It is to be understood that although the present invention has been described with regard to preferred embodiments thereof, various other embodiments and variants may occur to those skilled in the art. Such other embodiments and variants which are within the scope and spirit of the invention are intended to be covered by the following claims.

What is claimed is:

1. An engine control system for an automotive vehicle for controlling output of an engine according to an amount of intake air taken into the engine, said amount of intake air being introduced into the engine at an end of an intake stroke and being estimated based on a change in an amount of intake air actually introduced into the engine before said end of an intake stroke, said engine control system comprising:

an air amount sensor for detecting an actual amount of intake air introduced into an engine;

engine operating condition detecting means for detecting engine operating conditions within a specified range which cause pulsations of intake air at levels higher than a specified level; and control means for (1) detecting a change in an actual amount of intake air detected prior to an end of an intake stroke by said air amount sensor, (2) estimating a required amount of intake air to be introduced at said end of an intake stroke based on said change, (3) imposing a restriction on estimation of said required amount of intake air when said engine operating condition detecting means detects engine operating conditions in said specified range, and (4) controlling output of said engine based on said estimation of said required amount of intake air.

2. An engine control system as defined in claim 1, wherein said restriction is imposed by prohibiting said estimation of said required amount of intake air.

3. An engine control system as defined in claim 1, wherein said control means estimates an estimation coefficient, based on said change, for estimation of said required amount of intake air.

4. An engine control system as defined in claim 3, wherein said restriction is imposed by establishing said estimation coefficient so that it is smaller when said engine operating condition detecting means detects engine operating conditions in said specified range than when said engine operating condition detecting means detects engine operating conditions out of said specified range.

5. An engine control system as defined in claim 1, wherein said air amount sensor comprises a hot wire air-flow sensor.

6. An engine control system as defined in claim 1, wherein said engine operating condition detecting means detects at least an engine load under which said engine operates and said control means prohibits said estimation of said required amount of intake air when said engine operating condition detecting means detects that the engine load is in said specified range.

7. An engine control system as defined in claim 3, wherein said engine operating condition detecting means detects at least an engine load under which said engine operates and said control means establishes said estimation coefficient so that it is smaller when said engine operating condition detecting means detects engine loads in said specified range than when said engine operating condition detecting means detects engine loads out of said specified range.

8. An engine control system for an automotive vehicle for controlling output of an engine according to an amount of intake air taken into the engine, said amount of intake air being introduced into the engine at an end of an intake stroke and being estimated based on a change in an amount of intake air actually introduced into the engine before said end of an intake stroke, said engine control system comprising:

an air amount sensor for detecting an actual amount of intake air introduced into an engine;

engine operating condition detecting means for detecting engine operating conditions within a specified range which cause pulsations of intake air at levels higher than a specified level; and control means for (1) detecting a change in an actual amount of intake air detected prior to an end of an intake stroke by said air amount sensor, (2) estimating a required amount of intake air to be introduced at said end of an intake stroke based on said change (3) controlling a control parameter with which engine output is controlled based on estimation of said required amount of intake air, and (4) interrupting control of said control parameter when said engine operating condition detecting means detects engine operating conditions in said specified range.

9. An engine control system as defined in claim 8, wherein said control means controls a pulse width of a fuel injection pulse according to said required amount of intake air.

10. An engine control system as defined in claim 8, wherein said air amount sensor comprises a hot wire air-flow sensor.

11. An engine control system as defined in claim 8, wherein said engine operating condition detecting means detects at least an engine load under which said engine operates and said control means prohibits said estimation of said required amount of intake air when said engine operating condition detecting means detects that the engine load is in said specified range.

12. An engine control system as defined in claim 8, wherein said control means interrupts said control of said control parameter after a predetermined period of time from when said engine operating condition detecting means detects that the engine load is in said specified range.

13. An engine control system as defined in claim 12, wherein said control means further tempers said actual amount of intake air with a volumetric factor intrinsic to said engine and a difference between said actual amount of intake air and a tempered amount of intake air so as to impose a constraint on said control of said control parameter when said difference is less than a predetermined value and said engine operating condition detecting means detects engine operating conditions in said specified range.

14. An engine control system as defined in claim 8, wherein said control means interrupts said estimation of said required amount of intake air after a predetermined period of time from when said engine operating condition detecting means detects that the engine load is in said specified range.

15. An engine control system as defined in claim 14, wherein said control means further tempers said actual amount of intake air with a volumetric factor intrinsic to said engine and a difference between said actual amount of intake air and a tempered amount of intake air so as to impose a constraint on said estimation of said required amount of intake air when said difference is less than a predetermined value and said engine operating condition detecting means detects engine operating conditions in said specified range.

* * * * *